US009085028B2

(12) United States Patent
Cha

(10) Patent No.: US 9,085,028 B2
(45) Date of Patent: Jul. 21, 2015

(54) METHOD FOR MANUFACTURING VALVE TRAIN PARTS USING METAL POWDER INJECTION MOLDING

(71) Applicants: Hyundai Motor Company, Seoul (KR); Kia Motors Corporation, Seoul (KR)

(72) Inventor: Sung-Chul Cha, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 290 days.

(21) Appl. No.: 13/715,882

(22) Filed: Dec. 14, 2012

(65) Prior Publication Data

US 2014/0041222 A1 Feb. 13, 2014

(30) Foreign Application Priority Data

Aug. 10, 2012 (KR) ..... 10-2012-0088032

(51) Int. Cl.

| | |
|---|---|
| ***B21K 1/22*** | (2006.01) |
| ***B22F 3/22*** | (2006.01) |
| ***F01L 1/00*** | (2006.01) |
| ***B22F 1/00*** | (2006.01) |
| ***B22F 5/10*** | (2006.01) |
| *F01L 13/00* | (2006.01) |

(52) U.S. Cl.

CPC ..... *B21K 1/22* (2013.01); *B22F 1/0059* (2013.01); *B22F 3/225* (2013.01); *B22F 5/10* (2013.01); *F01L 1/00* (2013.01); *B22F 2998/10* (2013.01); *B22F 2999/00* (2013.01); *F01L 13/0063* (2013.01); *Y10T 29/49298* (2015.01)

(58) Field of Classification Search

CPC ..... B21K 1/20; B21K 1/22; B21K 2/35; B21K 1/205; B22F 1/0059; B22F 3/10; B22F 3/225; B22F 5/008; B22F 5/10; B22F 2003/248; B22F 2201/32; B22F 2998/10; B22F 2999/00; B22F 2301/35; B22F 2/1021; F01L 1/18; F01L 13/0063

USPC ..... 29/888.4

See application file for complete search history.

(56) References Cited

U.S. PATENT DOCUMENTS

| | | | | |
|---|---|---|---|---|
| 6,143,240 | A * | 11/2000 | Jones et al. | 419/25 |
| 2005/0163645 | A1* | 7/2005 | Xu et al. | 419/28 |
| 2010/0015432 | A1* | 1/2010 | Bergmark et al. | 428/323 |
| 2010/0267542 | A1* | 10/2010 | Kang | 501/87 |
| 2011/0103995 | A1* | 5/2011 | Klekovkin et al. | 419/29 |

(Continued)

FOREIGN PATENT DOCUMENTS

| | | | |
|---|---|---|---|
| GB | 1446486 | A * | 8/1976 |
| JP | 60169501 | A | 9/1985 |

(Continued)

*Primary Examiner* — Alexander P Taousakis

(74) *Attorney, Agent, or Firm* — Mintz Levin Cohn Ferris Glovsky and Popeo, P.C.; Peter F. Corless

(57) ABSTRACT

Disclosed is a method for manufacturing a plurality of valve train parts using metal powder injection molding, comprising: obtaining a raw material for injection molding by mixing a metal powder and a binder; forming a formed body by injecting the obtained raw material for injection molding into a mold of a valve train part shape; solvent extracting the formed body; forming a sintered body by debinding and sintering the solvent extracted formed body; sizing processing the sintered body; vacuum carburizing the sizing processed sintered body; and polishing the vacuum carburized sintered body.

6 Claims, 6 Drawing Sheets

(56) References Cited

U.S. PATENT DOCUMENTS

| | | | | |
|---|---|---|---|---|
| 2011/0109020 | A1* | 5/2011 | Iwasaki et al. | 264/643 |
| 2011/0123384 | A1* | 5/2011 | Park | 419/18 |
| 2012/0073303 | A1* | 3/2012 | McCarren et al. | 60/752 |
| 2012/0167716 | A1* | 7/2012 | Matheson | 75/308 |
| 2012/0251377 | A1* | 10/2012 | Hwang et al. | 419/14 |
| 2013/0156626 | A1* | 6/2013 | Roth-Fagaraseanu et al. | 419/6 |
| 2013/0259732 | A1* | 10/2013 | Schult et al. | 419/6 |
| 2013/0315774 | A1* | 11/2013 | Cheng et al. | 419/28 |
| 2014/0105778 | A1* | 4/2014 | Kim et al. | 419/28 |
| 2014/0227124 | A1* | 8/2014 | Lee et al. | 419/36 |

FOREIGN PATENT DOCUMENTS

| | | | |
|---|---|---|---|
| JP | 09279202 | A | 10/1997 |
| JP | 2004124141 | A | 4/2004 |
| KR | 10-2008-0040270 | A | 5/2008 |

* cited by examiner

METHOD FOR MANUFACTURING VALVE TRAIN PARTS USING METAL POWDER INJECTION MOLDING

CROSS-REFERENCE TO RELATED APPLICATION

This application claims priority under 35 U.S.C. §119 to Korean Patent Application No. 10-2012-88032, filed on Aug. 10, 2012, in the Korean Intellectual Property Office, the disclosure of which is incorporated herein by reference in its entirety.

BACKGROUND (a) Technical Field

The present invention relates to a method for manufacturing valve train parts using metal powder injection molding, more particularly, to a method for manufacturing valve train parts using metal powder injection molding having improved physical properties by replacing the conventional investment casting method with metal powder injection molding, which has greater dimensional accuracy thereby reducing the cost, and by controlling the powder composition.

(b) Background Art

An internal-combustion engine is an apparatus generating powder by combusting air and a fuel, which are suctioned from the exterior, in a combustion chamber, and the apparatus has an intake valve for suctioning the air and the fuel into the combustion chamber and an exhaust valve for releasing detonated gas combusted in the combustion chamber. These intake and exhaust valves open and close by a camshaft, which rotates by interlocking to the rotation of a crankshaft. Additionally, a series of parts for operating the intake and exhaust valves, such as a drive cam, a camshaft, a tappet, a rocker arm and a rocker arm link, is called a valve train.

Moreover, the automobile industries are developing various environmentally friendly vehicles by aiming to reduce carbon dioxide emissions to 50 g/km, which is 35~50% of the current level, until 2020, and the industries are concentrating on technical development to satisfy fuel efficiency of 23.2 km/l (54.5 mpg), US Corporate Average Fuel Economy regulations in 2025.

Recently, a Continuous Variable Valve Lifter (CVVL), which maximizes fuel efficiency and engine performance by optimizing the amount of air intake by controlling the height of the intake valve according to engine rotation speed, is being applied to a vehicle engine.

FIG. 1 is an exemplary view showing a rocker arm; FIG. 2 is an exemplary view showing a rocker arm link; FIG. 3 is an exemplary view showing a combination structure of a rocker arm and a rocker arm link; and FIG. 4 is an exemplary view showing a continuous variable valve lifter, and as shown in FIGS., the rocker arm 100 and the rocker arm link 110 work as the parts of the continuous variable valve lifter 120.

Since the valve train parts such as the rocker arm 100 and the rocker arm link 110 must be used for long periods of time under harsh conditions, a high durability and accuracy such as strength, abrasion resistance, and impact resistance are needed.

Previously, the investment casting method, which has relatively higher dimensional accuracy compared with common casting methods, was used to manufacture the valve train parts, but there is a need of many additional processes to obtain the final shapes after casting due to the sophisticated shapes of the valve train parts.

Moreover, when the valve train parts are manufactured by the investment casting method, they exhibit high mechanical strength but reduced dimensional accuracy and thus the processing cost and material loss due to the additional processes increased.

The description provided above as a related art of the present invention is just for helping understanding the background of the present invention and should not be construed as being included in the related art known by those skilled in the art.

SUMMARY OF THE DISCLOSURE

The present invention has been made in an effort to solve the above-described problems associated with prior art. The present invention provides a method for manufacturing a plurality of valve train parts using a metal powder injection molding, which has improved dimensional accuracy. Furthermore, the present invention may improve economical efficiency by using metal powder injection molding instead of the conventional investment casting method as a general manufacturing method of a valve train parts, and the method can be applied under harsh conditions such as in an engine by establishing the optimum powder composition and process condition.

The method for manufacturing a plurality of valve train parts using metal powder injection molding according to the present invention comprises: obtaining a raw material for injection molding by mixing a metal powder and a binder; forming a formed body by injecting the obtained raw material for injection molding into a mold of a valve train part shape; solvent extracting the formed body; forming a sintered body by debinding and sintering the solvent extracted formed body; sizing processing the sintered body; carburizing the sizing processed sintered body; and polishing the vacuum carburized sintered body.

Further, in one embodiment of the present invention, in obtaining a raw material for injection molding, a metal powder of 93% by weight and a binder of 7% by weight is mixed. The metal powder comprises: nickel (Ni) 2% by weight, molybdenum (Mo) 0.5% by weight, carbon (C) 0.25% by weight and of the remaining percent by weight of iron (Fe) of the entire composition.

Additionally, in forming a sintered body, argon gas is used under vacuum condition, and the debinded formed body is heated to 1250° C. or higher for 2 hrs (e.g., soaking). Moreover, in vacuum carburizing, the sizing processed sintered body is heated to 890° C. and the sizing processed sintered body is carburized using acetylene ($C_2H_2$) gas for 1 hr, and then carbon is diffused at 890° C. for 10 min followed by cooling to 820° C. and diffusing the carbon at the same temperature for 20 min.

In another embodiment of the present invention, vacuum carburizing, includes heating the sizing processed sintered body to 180° C., holding the temperature constant for 90 min and then cooling the sintered body, after quenching the carbon diffused sintered body using an oil bath at 80° C.

Further, the valve train parts is a rocker arm or a rocker arm link.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
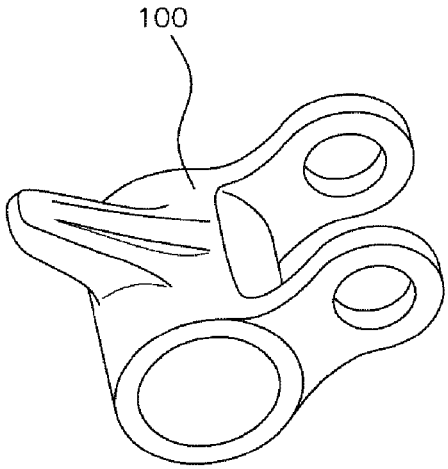
FIG. 1 is an exemplary view showing a rocker arm, according to the related art.
Figure 2:
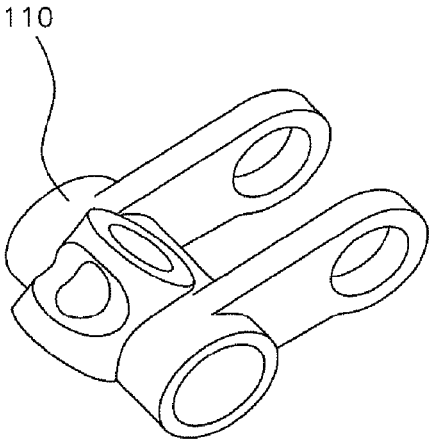
FIG. 2 is an exemplary view showing a rocker arm link, according to the related art.
Figure 3:
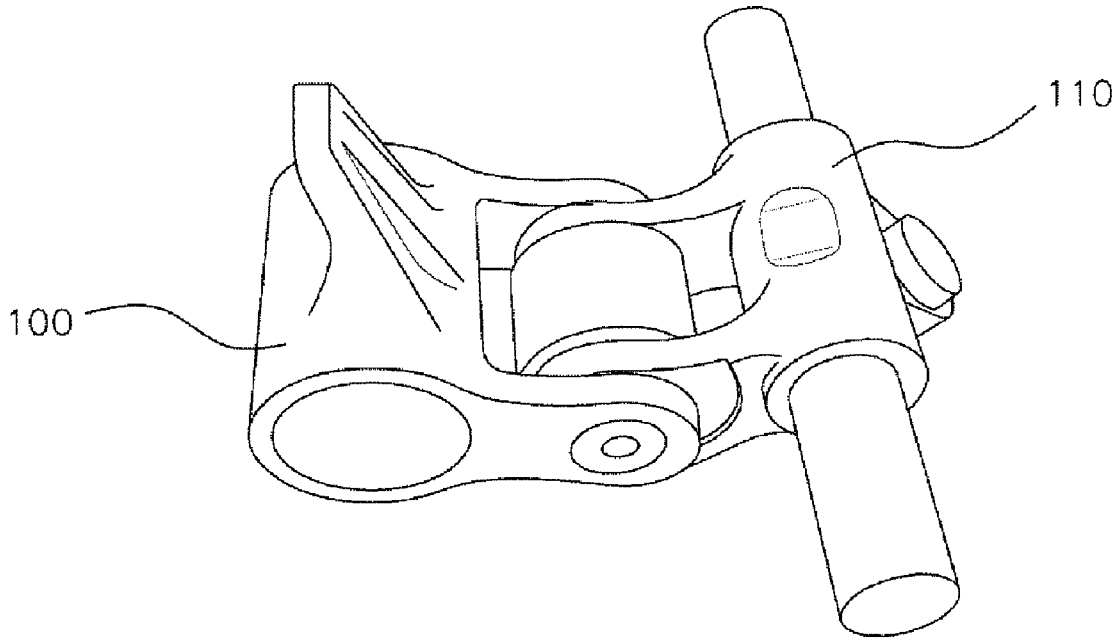
FIG. 3 is an exemplary view showing a combination structure of a rocker arm and a rocker arm link, according to the related art.
Figure 4:
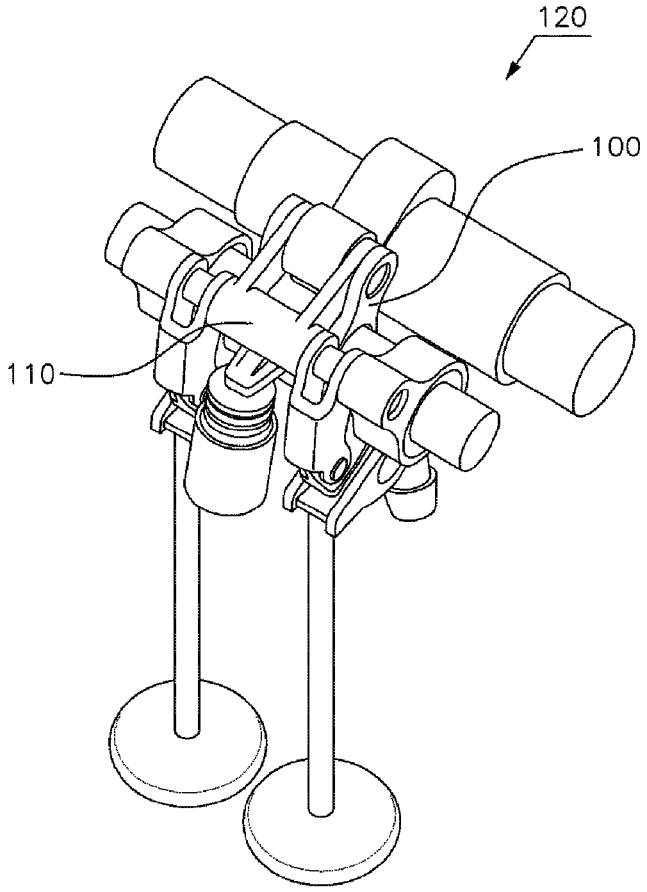
FIG. 4 is an exemplary view showing a continuous variable valve lifter, according to the related art.

It should be understood that the accompanying drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, the present invention now will be described in detail with reference to the accompanying drawings.

The present invention replaces the conventional investment casting method for manufacturing the valve train parts with metal powder injection molding having greater dimensional accuracy.

The metal powder injection molding (MIM) is a new powder metallurgy molding technique, which is a combination of a powder metallurgy technique and an injection molding method for mass production of detailed plastic parts, and the method may comprise: mixing a fine metal powder and a binder, injection molding the mixture into a mold, removing the binder from the injection molded body, and sintering only the powder at a high temperature to obtain the parts for the valve train.

Furthermore, products manufactured by the metal powder injection molding generally have improved dimensional accuracy than those by the investment cast. Accordingly, of the related art required post treatment processes such as heat treatment to the surface for enhancing physical properties. In the related art, it is difficult to obtain the desired physical properties because of difficulty of carbon control in the materials (e.g., difference between thin-walled part and thick-walled part) because Fe-2 wt % Ni-0.9 wt % C was decarbonized.

Figure 5:
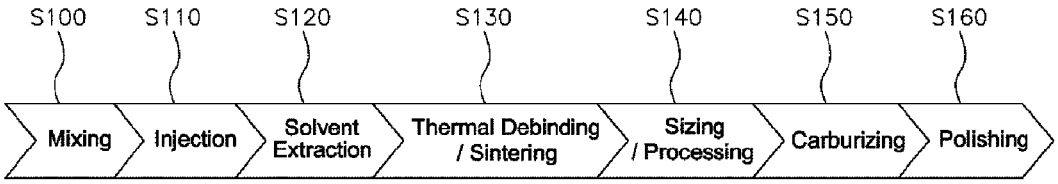
FIG. 5 is an exemplary flow chart showing the method for manufacturing valve train parts using metal powder injection molding according to an exemplary embodiment of the present invention.

FIG. 5 is an exemplary flow chart showing the method for manufacturing valve train parts using metal powder injection molding according to an exemplary embodiment of the present invention, and this will be described in detail with following embodiments.

1. Mixing Step (S100)

A metal powder and a binder may be mixed to obtain a raw material for injection molding. The binder may be added for fluidity and maintaining a shape of the metal powder during injection molding, and it may be a common organic binder comprising a binding agent such as polyethylene or a lubricating agent (e.g., paraffin wax and stearic acid). Specifically, the mixing may homogeneously conducted to have the metal powder of about 93% by weight and the binder of about 7% by weight to obtain the raw material for injection molding.

When the amount of the metal powder is less than about 93% by weight, fluidity may still be good during injection but the debinding process may take longer. Thus, when the amount of metal powder is more than about 93% by weight, the formed body may exhibits low strength during injection.

Further, the metal powder may be mixed by supplying each metal atom separately and then adding molybdenum (Mo) thereto, and specifically, carbonyl Fe(1) (containing carbon (C) about 0.76% by weight), carbonyl Fe(2) (containing carbon (C) about 0.03% by weight), nickel (Ni) and molybdenum (Mo) may be mixed to have the ratio of nickel (Ni) about 2% by weight, molybdenum (Mo) about 0.5% by weight, carbon (C) about 0.25% by weight and the remaining percent by weight of iron (Fe) of the entire composition.

Additionally, the mixing may be performed at about 160° C. for about 3 hrs at about 30 rpm. When mixing at a lower temperature for a shorter period of time, the binder may not mix due to its fluidity, and when mixing at a higher temperature for a longer period of time, the binder may be debinded during mixing.

2. Injection Step (S110)

The obtained raw material for injection molding may be injected into a mold of a valve train part shape under the condition of: a nozzle temperature of about 145° C., an injection speed of about 33 mm/s, an injection pressure of about 3.5 MPa and a mold temperature of about 30° C. to form a formed body. The nozzle temperature and the mold temperature may be determined according to the fluidity of the raw material for injection molding and the evaporation of the binder, and the injection pressure and the injection speed may be determined according to smooth injection and overload of an injection molding apparatus.

3. Solvent Extraction Step (S120)

The formed body formed by the above method may be immersed in a normal heptane (n-heptane) solution in advance to shorten the debinding time, and may be solvent extracted at about 40° C. for about 10 to 12 hrs to remove most of the binder in the formed body. When the temperature is greater than 40° C., cracks may form due to the reaction speed for removing the binder becoming too fast before a proper extraction path is formed inside the formed body, and thus stress may be concentrated inside the formed body.

Further, when the temperature is less than 40° C., cracks are may not form but the process cost may increase due to the length of time needed to extract the solvent.

4. Debinding and Sintering Step (S130)

Figure 6:
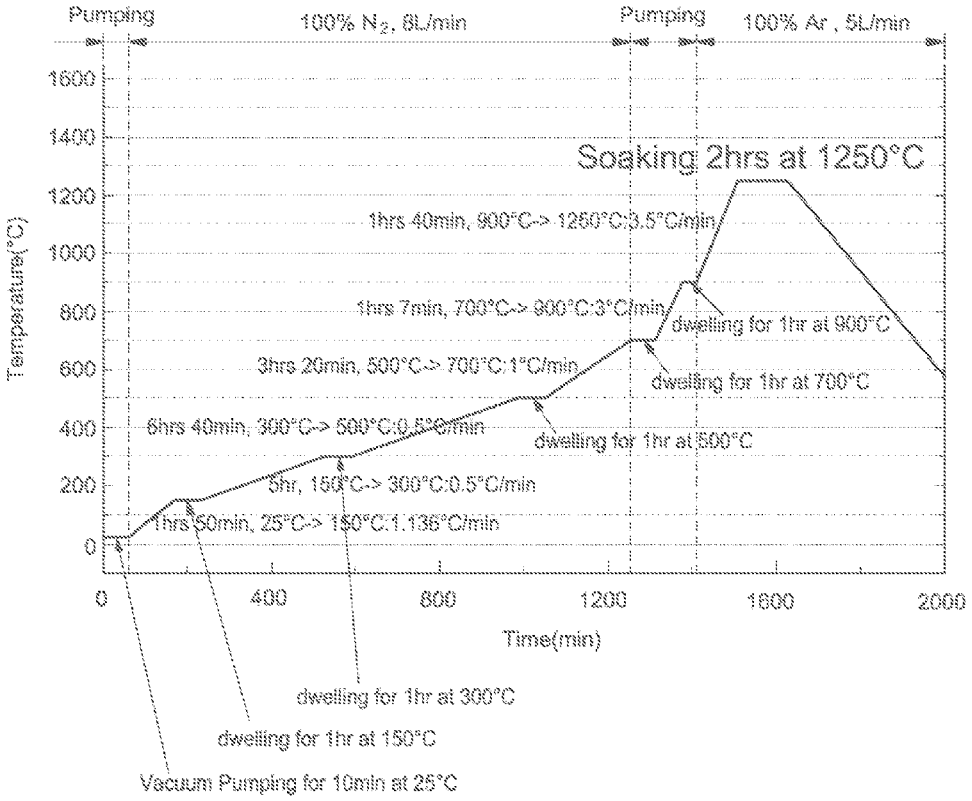
FIG. 6 is an exemplary graph showing the debinding and sintering process according to an exemplary embodiment of the present invention.

FIG. 6 is an exemplary graph showing the debinding and sintering process according to an exemplary embodiment of the present invention.

The debinding is a process configured to substantially remove the binder in the formed body before sintering, and thermal debinding may be conducted to remove the binder remained in the solvent extracted formed body.

A general method for removing the binder is a method in which the binder may be evaporated through thermal debinding by slowly heating the formed body. However, when the binder is evaporated, deformation of the formed body such as torsion or bending may occur because most of the binders slowly evaporate at a lower temperature but may suddenly evaporated when a certain temperature is reached.

Accordingly, as shown in FIG. 6, to prevent the deformation of the formed body, vacuum pumping may be conducted at about 25° C. for about 10 min, nitrogen ($N_2$) gas may be filled at the rate of about 8 L/min, and the temperature may be increased and maintained to remove the binder in steps to minimize the deformation of the formed body.

Moreover, a path for debinding the binder may be formed inside the formed body in a low-temperature range, the debinding of the binder for a lower temperature may be performed in a mid-temperature range, and the debinding of the binder for a higher temperature may be performed in a high-temperature range sequentially.

Additionally, the vacuum condition may be performed by pumping, argon (Ar) gas supplied at the rate of about 5 L/min, the debinded formed body may be heated to about 1250° C. or higher, and sintering, wherein the temperature may be held for about 2 hrs (e.g., soaking), may be performed sequentially to form the sintered body. During sintering, the formed body may be solidified by densification and particle growth. The sintering may be performed in a separate sintering furnace, but it may be continuously performed followed by debinding in a vacuum debinding sintering furnace.

5. Sizing Processing Step (S140)

To determine the dimension of the sintered body, the sintered body may be subjected to a sizing processing at a pressure of about 100 kgf/cm$^2$.

6. Vacuum Carburizing Treatment Step (S150)

Figure 7:
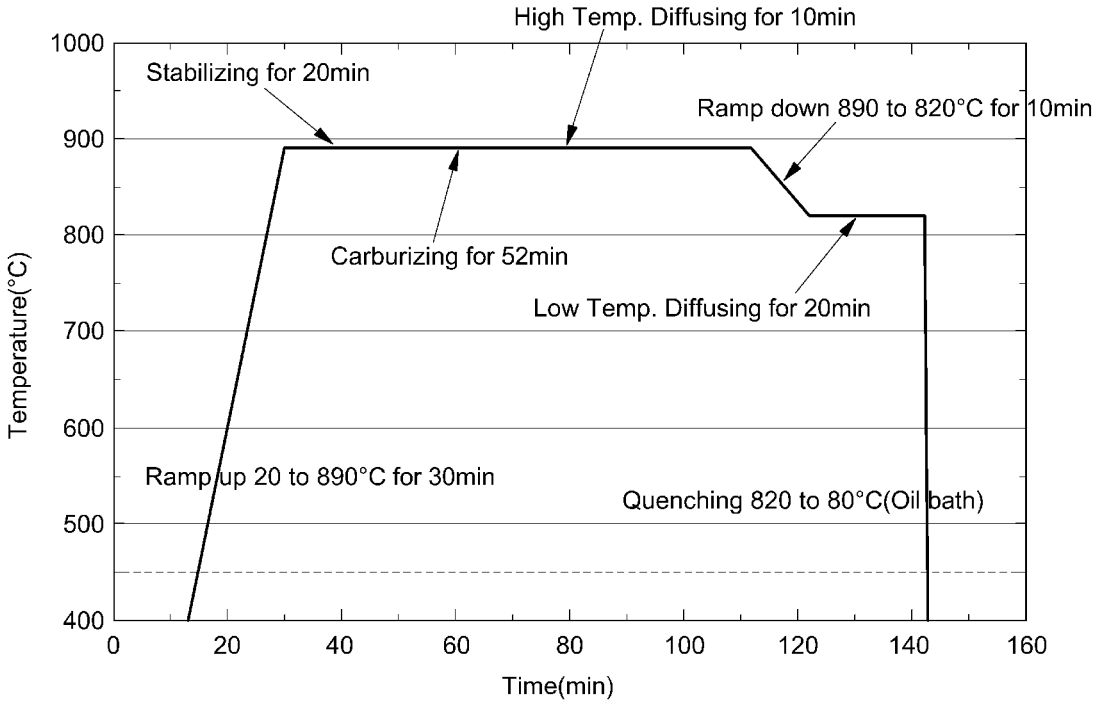
FIG. 7 is an exemplary graph showing the vacuum carburizing and quenching process according to an exemplary embodiment of the present invention.

FIG. 7 is an exemplary graph showing the vacuum carburizing and quenching process according to an exemplary embodiment of the present invention. As shown in FIG. 7, the sizing processed sintered body may be heated to the carburizing temperature of about 890° C. for about 30 min, and then carburizing may be performed using acetylene ($C_2H_2$) gas as a carbon source for about 1 hr.

Furthermore, the carburized carbon may be diffused for about 40 min by maintaining the temperature at about 890° C. for about 10 min and lowering the temperature to about 820° C. for about 10 min and maintaining the temperature at about 820° C. for about 20 min.

Additionally, the carbon-diffused sintered body may be quenched using an oil bath to about 80° C. to secure hardness and strength, and tempering may be performed, which raises the temperature to about 180° C., to maintain the temperature for about 90 min and then lower the temperature, to enhance tenacity.

Moreover, a hardened layer having uniform case depth may be obtained regardless of a thickness by using acetylene ($C_2H_2$) gas as the carburizing and controlling the carbon potential pulse by carburizing at a vacuum atmosphere.

7. Polishing Step (S160)

The vacuum carburized sintered body may be polished for about 2 hrs to make the surface thereof smooth.

TABLE 1

| Depth (mm) | Rocker Arm Hardness (Hv 0.3) |
|---|---|
| 0 | 684.9 |
| 0.05 | 707.1 |
| 0.1 | 675.4 |
| 0.2 | 670.7 |
| 0.3 | 586.3 |
| 0.4 | 560 |
| 0.5 | 557.1 |
| 0.6 | 529.9 |
| 0.7 | 475.6 |
| 1 | 385.3 |
| 1.5 | 385.3 |
| 2 | 395.6 |

Figure 8:
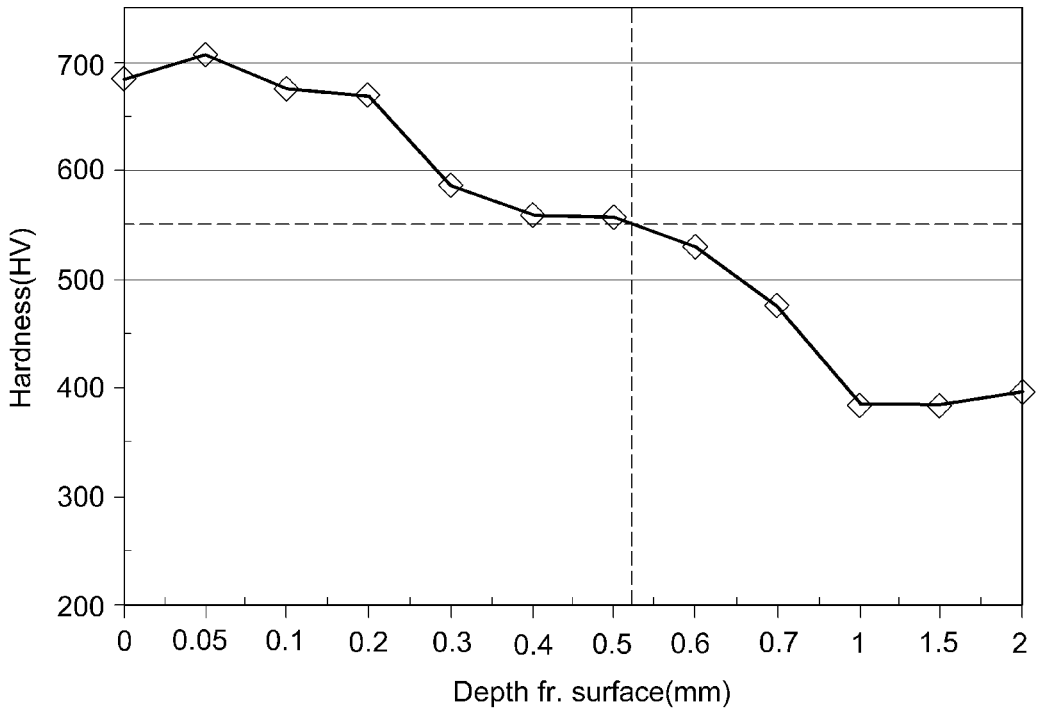
FIG. 8 is an exemplary graph showing a result of a hardness test of the valve train parts (rocker arm) according to an exemplary embodiment of the present invention.

FIG. 8 and the Table 1 are an exemplary graph and table showing a result of hardness test of the valve train parts (e.g., rocker arm) according to an exemplary embodiment of the present invention. As shown therein, as a result of the carburizing heat treatment, the rocker arm 100 had hardness of about 700 Hv at the surface thereof, and a hardness of about 400 Hv or more from the surface to the deep part thereof; its effective case depth was about 0.52 mm; and the density was 7.6 g/cc.

From results of various tests, fundamental physical properties of the rocker arm 100 may show: a density of 7.5 g/cc, a surface hardness of 650 Hv or more, a hardness from the surface to the deep part of 300 Hv or more, and an effective case depth of 0.3 to 0.6 mm.

Further, as a result of measuring mechanical strength of the rocker arm 100 manufactured according to the present invention, the rocker arm showed a tensile strength of 940 MPa, an elongation ratio of 0.5% and an impact strength of 9.1 J/cm$^2$, and The present invention may reduce the costs by reducing the process cost and the material loss resulted from the additional processing processes. (e.g., Dimensional accuracy of the rocker arm 100 according to the present invention is about 0.13%, which is about 5 times better than that of the rocker arm 100 according to the conventional investment casting method of 0.65%) by replacing the conventional investment casting method with a metal powder injection molding method having high dimensional accuracy.

Further, in spite of manufacturing by the metal powder injection molding, the present invention has an advantage of securing physical properties equal to those of the conventional investment casting method, for example the improved strength and surface hardness, by uniform carburizing enabled by controlling the composition and the process condition.

The invention has been described in detail with reference to exemplary embodiments thereof. However, it will be appreciated by those skilled in the art that changes or modifications may be made in these embodiments without departing from the principles and spirit of the invention, the scope of which is defined in the accompanying claims and their equivalents.

What is claimed is:

1. A method for manufacturing a valve train part using a metal powder injection molding comprising:

obtaining a raw material for injection molding by mixing a metal powder and a binder;

forming a formed body by injecting the obtained raw material for injection molding into a mold of a valve train part shape;

solvent extracting the formed body;

forming a sintered body by debinding and sintering the solvent extracted formed body;

sizing processing the sintered body;

vacuum carburizing the sizing processed sintered body; and polishing the vacuum carburized sintered body, wherein, the vacuum carburizing, includes:

heating the sizing processed sintered body to about 890° C.;

carburizing the sizing processed sintered body using an acetylene ($C_2H_2$) gas for 1 hr;

diffusing the carbon at about 890° C. for 10 min;

cooling the sizing processed sintered body to about 820° C.; and diffusing the carbon at about 820° C. for 20 min.

2. The method for manufacturing the valve train part using metal powder injection molding according to claim 1, wherein, in obtaining the raw material for injection molding, the metal powder of about 93% by weight and the binder of about 7% by weight is mixed.

3. The method for manufacturing the valve train part using metal powder injection molding according to claim 2, wherein the metal powder comprises: nickel (Ni) about 2% by weight, molybdenum (Mo) about 0.5% by weight, carbon (C) about 0.25% by weight and the remaining percent by weight of iron (Fe) of the entire composition.

4. The method for manufacturing the valve train part using metal powder injection molding according to claim 1, wherein, in forming a sintered body, argon gas is used under vacuum condition, and the debinded formed body is heated to about 1250° C. or higher for 2 hrs.

5. The method for manufacturing the valve train part using metal powder injection molding according to claim 1, wherein, the vacuum carburizing, includes:

heating the sizing processed sintered body to about 180° C., maintaining the temperature for 90 min; and cooling the sizing processed sintered body after quenching the carbon diffused sintered body using an oil bath at about 80° C.

6. The method for manufacturing the valve train part using metal powder injection molding according to any one of claim 1, wherein the plurality of valve train parts includes a rocker arm or a rocker arm link.

* * * * *